US008096411B2

(12) United States Patent
Bailey et al.

(10) Patent No.: US 8,096,411 B2
(45) Date of Patent: Jan. 17, 2012

(54) DISPENSING CONTAINER

(75) Inventors: Ryan A. Bailey, Raleigh, NC (US); John A. Gelardi, Wake Forest, NC (US)

(73) Assignee: R. J. Reynolds Tabacco Company, Winston-Salem, NC (US)

( * ) Notice: Subject to any disclaimer, the term of this patent is extended or adjusted under 35 U.S.C. 154(b) by 111 days.

(21) Appl. No.: 12/685,819

(22) Filed: Jan. 12, 2010

(65) Prior Publication Data

US 2011/0168712 A1 Jul. 14, 2011

(51) Int. Cl.
*B65D 83/04* (2006.01)
*A61J 1/00* (2006.01)

(52) U.S. Cl. ..... 206/1.5; 206/528; 206/468

(58) Field of Classification Search ..... 206/1.5, 206/531, 539, 807, 528, 828, 262, 538, 536, 206/468, 242, 249; 221/154, 197, 246; 220/326
See application file for complete search history.

(56) References Cited

U.S. PATENT DOCUMENTS

| | | | |
|---|---|---|---|
| 194,197 | A | 8/1877 | Villaret |
| 1,701,565 | A | 2/1929 | Hammett |
| 1,837,722 | A | 12/1931 | McAtree |
| 2,090,530 | A | 8/1937 | Guffey et al. |
| 2,769,565 | A | 11/1956 | Sottile |
| 3,563,412 | A | 2/1971 | James |
| 3,696,917 | A | 10/1972 | Levi |
| 3,761,009 | A | 9/1973 | Rosenburg, Jr. |
| 3,782,584 | A | 1/1974 | Swenson et al. |
| 3,895,737 | A | 7/1975 | Phillips |
| B536,923 | I5 | 3/1976 | Mayled |
| 4,057,145 | A | 11/1977 | Wray et al. |
| 4,154,365 | A | 5/1979 | Lorca |
| 4,284,204 | A | 8/1981 | Carey, Jr. |
| 4,364,488 | A | 12/1982 | Anjou |
| 4,437,579 | A | 3/1984 | Obland |
| 4,561,544 | A | 12/1985 | Reeve |
| 4,572,376 | A | 2/1986 | Wrennall |
| 4,611,727 | A | 9/1986 | Graff |
| 4,705,165 | A | 11/1987 | Thieke |
| 4,939,860 | A | 7/1990 | Ackeret |
| 4,967,909 | A | 11/1990 | McKibben |
| 5,080,222 | A | 1/1992 | McNary |
| 5,082,137 | A | 1/1992 | Weinstein |
| 5,108,006 | A | 4/1992 | Tieke et al. |

(Continued)

FOREIGN PATENT DOCUMENTS

| | | | |
|---|---|---|---|
| CH | 180 218 | A | 10/1935 |

(Continued)

*Primary Examiner* — Steven A. Reynolds
(74) *Attorney, Agent, or Firm* — Womble Carlyle Sandridge & Rice, LLP

(57) ABSTRACT

The invention provides a dispensing container including an outer casing having an open end, a top, a bottom, sidewalls extending between the top and bottom, and an interior compartment, wherein the outer casing further includes a depressible button in the top or bottom and at least one projection adjacent to the depressible button that extends into the interior compartment; and an inner tray slidably received within the interior compartment of the outer casing. The inner tray includes a first end received within the outer casing, an opposing second end extending outwardly from the outer casing, a flexible locking tab positioned proximal to the first end, and an opening adjacent to the flexible locking tab, the flexible locking tab including a first segment extending toward the second end of the inner tray and a second segment extending transversely from the first segment. The second segment is positioned to engage the projection.

24 Claims, 6 Drawing Sheets

U.S. PATENT DOCUMENTS

| | | | | |
|---|---|---|---|---|
| 5,174,471 | A | 12/1992 | Kozlowski et al. | |
| 5,275,291 | A | 1/1994 | Sledge | |
| 5,657,901 | A | 8/1997 | Farside | |
| 5,782,359 | A | 7/1998 | McAllister et al. | |
| 5,816,441 | A | 10/1998 | Farside | |
| 5,897,025 | A | 4/1999 | Flewitt et al. | |
| 5,909,822 | A | 6/1999 | George et al. | |
| 5,915,560 | A | 6/1999 | George et al. | |
| 6,050,449 | A | 4/2000 | Kanj | |
| 6,131,765 | A | 10/2000 | Barry et al. | |
| 6,155,454 | A | 12/2000 | George et al. | |
| 6,267,265 | B1 | 7/2001 | Issa | |
| 6,382,460 | B1 | 5/2002 | González | |
| 6,460,693 | B1 | 10/2002 | Harrold | |
| 6,527,138 | B2 | 3/2003 | Pawlo et al. | |
| 6,564,967 | B1 | 5/2003 | Stringfield et al. | |
| 6,641,031 | B2 | 11/2003 | Evans et al. | |
| 6,758,338 | B2 | 7/2004 | Lien | |
| 6,863,175 | B2 | 3/2005 | Gelardi | |
| 6,913,149 | B2 | 7/2005 | Gelardi et al. | |
| 6,976,576 | B2 | 12/2005 | Intini | |
| 7,159,720 | B2 | 1/2007 | Pearson | |
| 7,216,776 | B2 | 5/2007 | Gelardi | |
| 7,287,666 | B2 | 10/2007 | De Laforcade | |
| 7,320,413 | B2 | 1/2008 | Fusi | |
| 7,533,785 | B2 | 5/2009 | Smith et al. | |
| 7,584,843 | B2 | 9/2009 | Kutsch et al. | |
| 7,793,784 | B2 * | 9/2010 | Nivala | 206/531 |
| 7,802,677 | B2 * | 9/2010 | Williams | 206/1.5 |
| 7,946,450 | B2 * | 5/2011 | Gelardi et al. | 221/154 |
| 2002/0175195 | A1 | 11/2002 | Cole | |
| 2003/0106900 | A1 | 6/2003 | Storz | |
| 2004/0074917 | A1 | 4/2004 | McHutchinson | |
| 2004/0217024 | A1 | 11/2004 | Arnarp et al. | |
| 2005/0173272 | A1 | 8/2005 | Lemmons, IV | |
| 2005/0183981 | A1 | 8/2005 | Gelardi | |
| 2005/0263539 | A1 | 12/2005 | Haggerty et al. | |
| 2006/0006091 | A1 * | 1/2006 | Maietta | 206/539 |
| 2006/0037484 | A1 | 2/2006 | Dixon et al. | |
| 2006/0060480 | A1 | 3/2006 | Budd | |
| 2006/0118589 | A1 | 6/2006 | Arnarp et al. | |
| 2006/0124658 | A1 | 6/2006 | Coe et al. | |
| 2006/0243611 | A1 | 11/2006 | Wu | |
| 2007/0068960 | A1 | 3/2007 | Valentine et al. | |
| 2007/0102318 | A1 * | 5/2007 | Gelardi et al. | 206/538 |
| 2007/0163911 | A1 | 7/2007 | Gelardi | |
| 2007/0246382 | A1 | 10/2007 | He | |
| 2007/0246383 | A1 | 10/2007 | He | |
| 2007/0277299 | A1 | 12/2007 | Kroon | |
| 2008/0142535 | A1 | 6/2008 | Adler et al. | |
| 2008/0283434 | A1 * | 11/2008 | Gelardi | 206/468 |
| 2009/0200332 | A1 | 8/2009 | Intini | |
| 2009/0223989 | A1 | 9/2009 | Gelardi | |
| 2009/0266837 | A1 | 10/2009 | Gelardi et al. | |

FOREIGN PATENT DOCUMENTS

| | | | |
|---|---|---|---|
| GB | 2 042 476 | A | 9/1980 |
| WO | WO 99/48391 | A | 9/1999 |
| WO | WO 2004/035404 | A1 | 4/2004 |
| WO | WO 2004/037657 | A3 | 5/2004 |
| WO | WO 2005/016036 | A1 | 2/2005 |
| WO | WO 2005/028316 | A2 | 3/2005 |
| WO | WO 2005/030606 | A1 | 4/2005 |
| WO | WO 2005/035390 | A1 | 4/2005 |
| WO | WO 2006/034450 | A1 | 3/2006 |
| WO | WO 2007/017761 | A2 | 2/2007 |
| WO | WO 2007/067953 | A2 | 6/2007 |
| WO | WO 2007/070867 | A2 | 6/2007 |
| WO | WO 2008/070032 | A2 | 6/2008 |
| WO | WO 2009/055547 | A1 | 4/2009 |

* cited by examiner

DISPENSING CONTAINER

FIELD OF THE INVENTION

The present invention relates to containers and methods of use thereof. More particularly, the invention relates to containers that provide dispensing or dosing of the stored product and a locking mechanism.

BACKGROUND OF THE INVENTION

Various types of containers for dispensing solid objects, particularly solid products intended for human consumption, are known in the art. Such containers are often characterized by a hand-held size that can be easily stored and transported. Exemplary consumable products that are often packaged in such containers include pharmaceutical compositions, oral tobacco products, snacks, mints, gums, breath strips, candy, and the like.

Certain consumable products, such as pharmaceutical products, require containers having a certain level of child resistance. Traditionally, pills have been packaged in a bottle having a cap that can only be removed by applying downward pressure while twisting the cap. However, this type of child resistance has certain disadvantages. For example, if a child does manage to open the bottle, immediate access is provided to the entire contents of the bottle. Further, if an adult user fails to place the cap in the properly secured position, there is no secondary mechanism for preventing access by a child.

Exemplary containers that provide a locking mechanism for enhancing child-resistance of a container can be found, for example, in U.S. Pat. Nos. 6,863,175 to Gelardi; 6,913,149 to Gelardi et al.; 6,976,576 to Intini; and 7,216,776 to Gelardi, and U.S. Patent Publication Nos. 2009/0223989 to Gelardi and 2009/0266837 to Gelardi et al., which are incorporated herein by reference in their entirety.

There remains a need in the art for a container for storing and dispensing a product capable of combining various advantageous features, such as child resistance and convenient size.

BRIEF SUMMARY OF THE INVENTION

The present invention provides a container that, in certain embodiments, combines child-resistance with a convenient handheld size. The type and form of the product to be stored and dispensed can vary, but pellet-shaped products are particularly well-suited for use with the containers of the invention.

In one aspect, the invention provides a dispensing container comprising: an outer casing having an open end, a top, a bottom, sidewalls extending between the top and bottom, and an interior compartment, wherein the outer casing further includes a depressible button in the top or bottom and at least one projection adjacent to the depressible button that extends into the interior compartment; and an inner tray slidably received within the interior compartment of the outer casing and comprising a storage compartment configured to store a plurality of units of product to be dispensed and a dispensing aperture through which units of product can be dispensed from the storage compartment, the inner tray extending outwardly from the open end of the outer casing and configured for sliding movement between a closed and locked position and a dispensing position. The inner tray further comprises a first end received within the outer casing, an opposing second end extending outwardly from the outer casing, a flexible locking tab positioned proximal to the first end, and an opening adjacent to the flexible locking tab, the flexible locking tab comprising a first segment extending toward the second end of the inner tray and a second segment extending transversely from the first segment. The second segment provides a surface facing the opening and operatively positioned to engage the at least one projection of the outer casing when the inner tray is in the closed and locked position. The depressible button of the outer casing is operatively positioned to engage and deflect the flexible locking tab of the inner tray when the inner tray is in the closed and locked position.

In certain embodiments, the projection of the outer casing has a beveled surface facing toward the open end of the outer casing. The inner tray may include at least one rib extending between the first segment and the second segment of the flexible locking tab, the rib having a beveled surface positioned to engage the beveled surface of the projection of the outer casing to facilitate movement of the inner tray between the dispensing position and the closed and locked position. Still further, in certain embodiments, the at least one projection further comprises a surface transverse to the top or bottom of the outer casing and positioned to engage the second segment of the flexible locking tab of the inner tray when the inner tray is in the closed and locked position. The inner tray may also include at least one rib extending between the first segment and the second segment of the flexible locking tab and having a surface positioned to engage the depressible button of the outer casing to facilitate deflection of the flexible locking button when the inner tray is in the closed and locked position.

In another embodiment, the second end of the inner tray comprises a lip extending transverse to the longitudinal axis of the inner tray, the lip positioned to abut the top or bottom of the outer casing. A depression is typically formed between the lip of the inner tray and the top or bottom of the outer casing for facilitating grasping of the inner tray.

In one embodiment, the storage compartment comprises a first section distal from the dispensing aperture and a narrower second section proximal to the dispensing aperture. The inner tray optionally further comprises a stop adapted for engaging the outer casing to prevent removal of the inner tray from the outer casing.

The type and shape of product contained in the dispensing container may vary. Exemplary product shapes include pill, tablet, sphere, sheet, coin, cube, bead, ovoid, obloid, bean, stick, and rod. Exemplary product types include pharmaceutical products, smoking products, smokeless tobacco products, snack products, and confectionary products (e.g., candies, mints, and gums).

In another embodiment, the invention provides a dispensing container comprising: an outer casing having an open end, a top, a bottom, sidewalls extending between the top and bottom, and an interior compartment, wherein the outer casing further includes a depressible button in the top or bottom and at least two projections adjacent to the depressible button that extend into the interior compartment, the projections having a beveled surface facing the open end of the outer casing and a surface transverse to the top or bottom of the outer casing facing the depressible button; and an inner tray slidably received within the interior compartment of the outer casing and comprising a storage compartment configured to store a plurality of units of product to be dispensed and a dispensing aperture through which units of product can be dispensed from the storage compartment, the inner tray extending outwardly from the open end of the outer casing and configured for sliding movement between a closed and locked position and a dispensing position. The inner tray further comprises a first end received within the outer casing, an opposing second end extending outwardly from the outer casing, a flexible locking tab positioned proximal to the first end, and an opening adjacent to the flexible locking tab, the flexible locking tab comprising a first segment extending toward the second end of the inner tray and a second segment extending transversely from the first segment. The second segment provides a surface facing the opening and operatively positioned to engage the transverse surface of the projections of the outer casing when the inner tray is in the closed and locked position. As noted above, the depressible button of the outer casing is operatively positioned to engage and deflect the flexible locking tab of the inner tray when the inner tray is in the closed and locked position.

In the above embodiment, the container can further include at least two ribs extending between the first segment and the second segment of the flexible locking tab, each of the ribs having a beveled surface positioned to engage the beveled surface of one of the projections of the outer casing to facilitate movement of the inner tray between the dispensing position and the closed and locked position.

In another aspect, the invention provides a method of dispensing a product from a container of the invention. The method includes providing a dispensing container according to any of the embodiments set forth herein with the inner tray in the closed and locked position; depressing the button in the outer casing to unlock the dispensing container, sliding the inner tray into the dispensing position; and removing a unit of product through the dispensing aperture. Thereafter, the inner tray can slide back into the original closed and locked position.

BRIEF DESCRIPTION OF THE DRAWINGS

Figure 1:
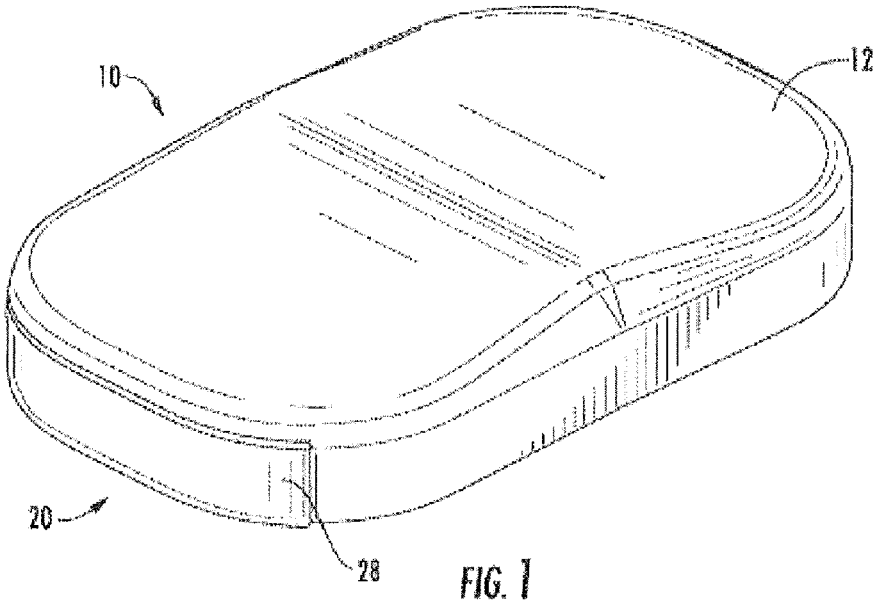
Figure 2:
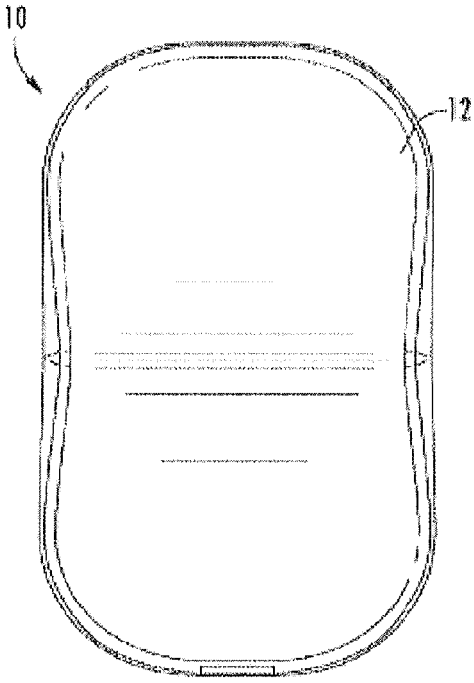
Figure 3:
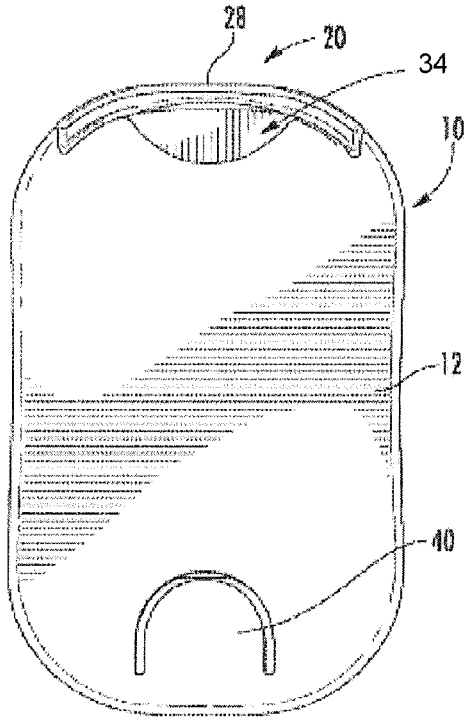
Figure 4:
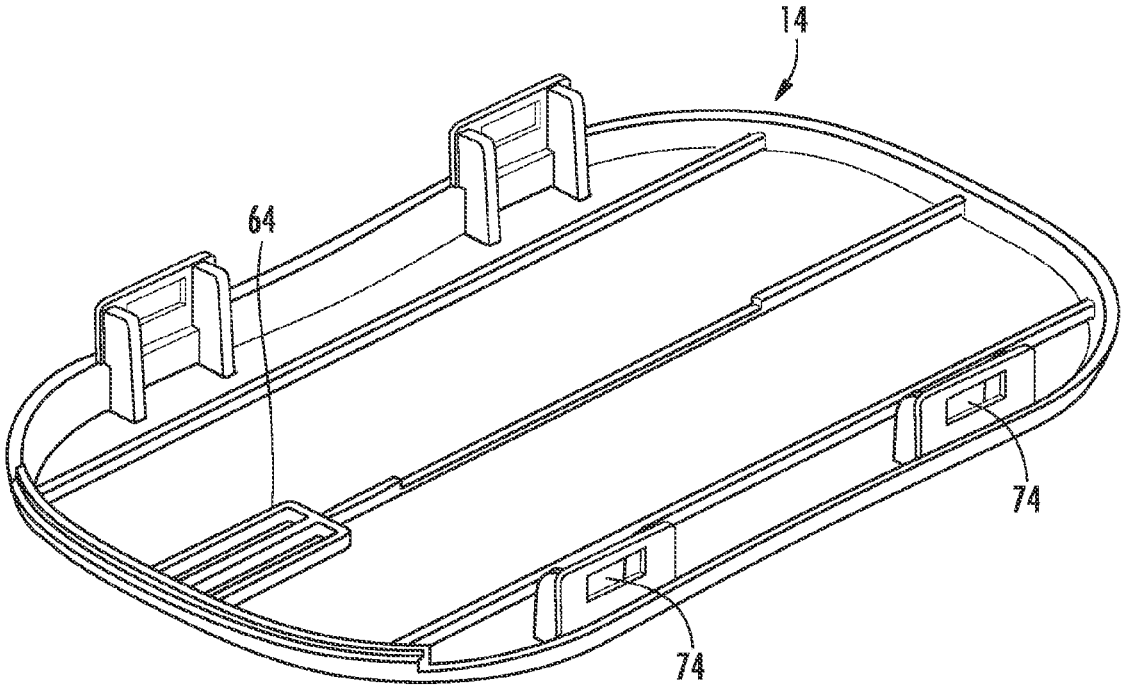
Figure 5:
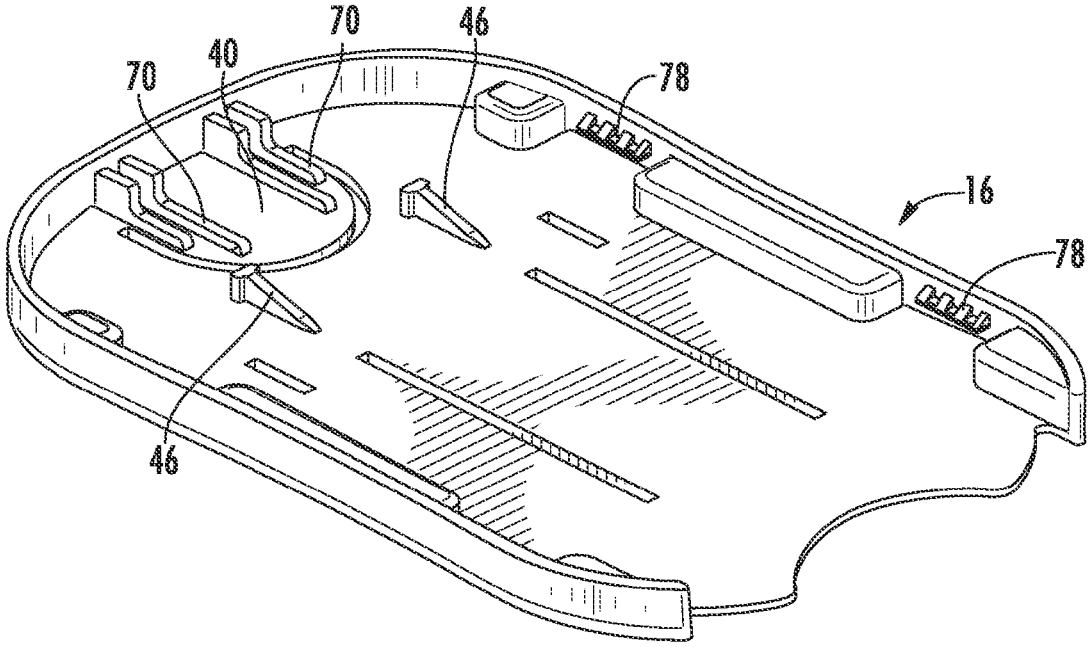
Figure 6:
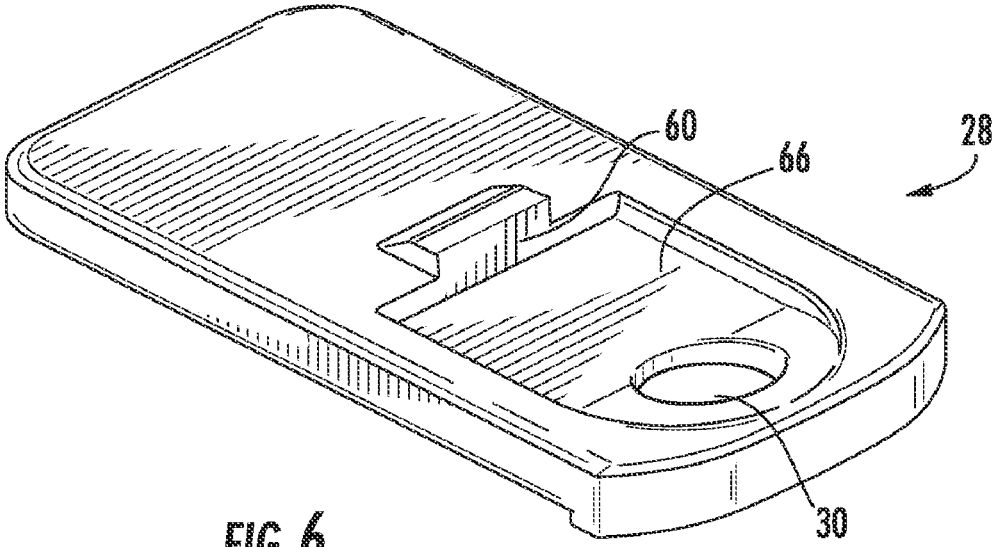
Figure 7:
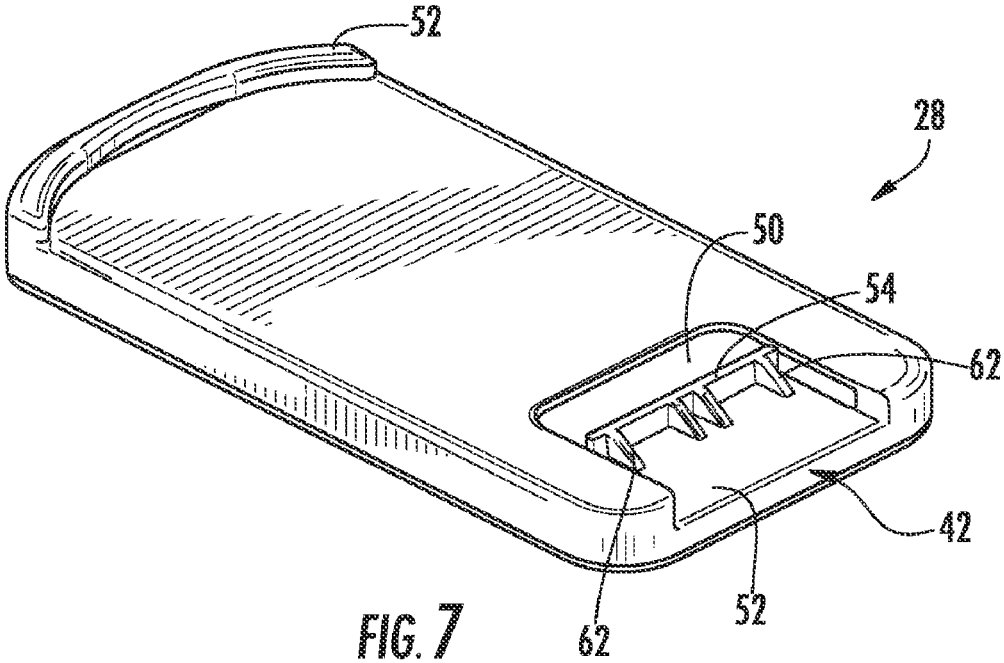
Figure 8:
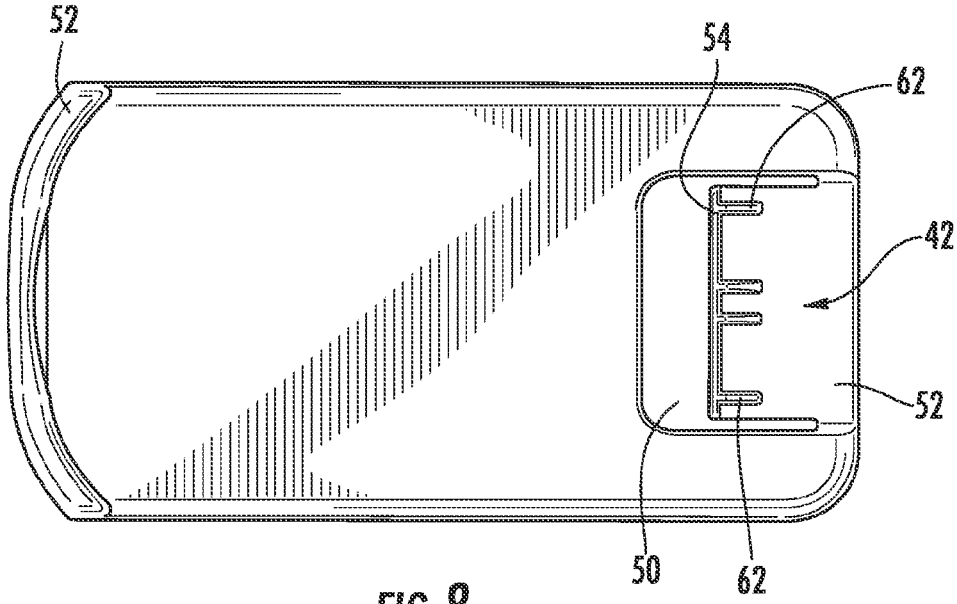
Figure 9:
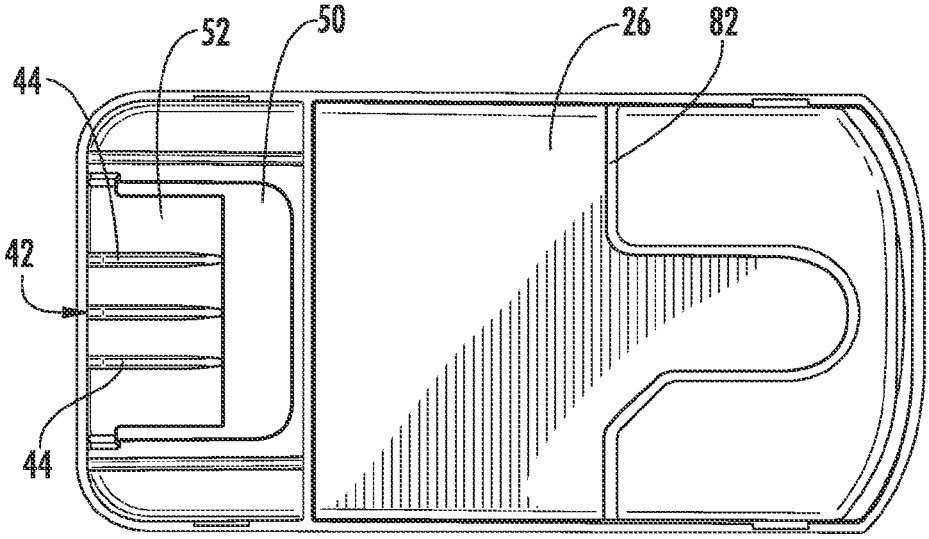
Figure 10:
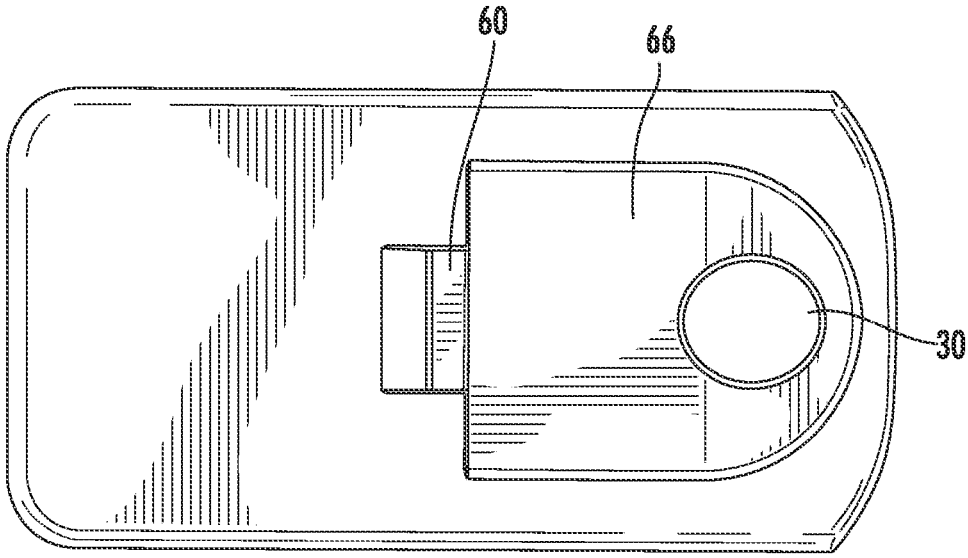
Figure 11:
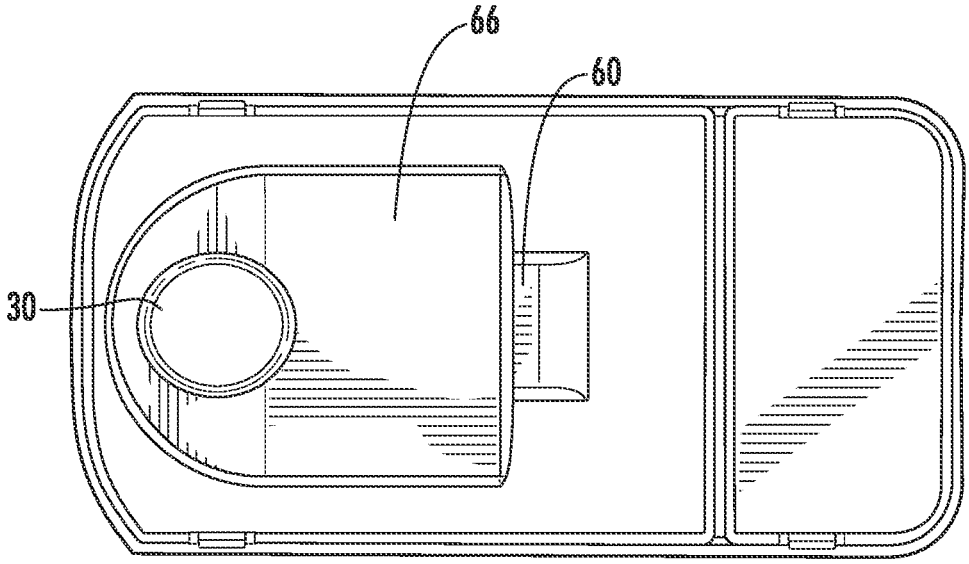

Having thus described the invention in general terms, reference will now be made to the accompanying drawings, which are not necessarily drawn to scale, and wherein:

FIG. 1 is a perspective view of a container embodiment of the invention facing the top surface thereof;

FIG. 2 is a top view of the container embodiment of FIG. 1;

FIG. 3 is a bottom view of the containing embodiment of FIG. 1;

FIG. 4 is a perspective view of the top of the outer casing of the container embodiment of FIG. 1 facing the interior surface thereof;

FIG. 5 is a perspective view of the bottom of the outer casing of the container embodiment of FIG. 1 facing the interior surface thereof;

FIG. 6 is a perspective view of the dispensing tray of the container embodiment of FIG. 1 facing the top surface thereof;

FIG. 7 is a perspective view of the dispensing tray of the container embodiment of Fig. facing the bottom surface thereof;

FIG. 8 is a side view of the exterior surface of the bottom of the dispensing tray of the container embodiment of FIG. 1;

FIG. 9 is a side view of the interior surface of the bottom of the dispensing tray of the container embodiment of FIG. 1;

FIG. 10 is a side view of the exterior surface of the top of the dispensing tray of the container embodiment of FIG. 1; and FIG. 11 is a side view of the interior surface of the top of the dispensing tray of the container embodiment of FIG. 1.

DETAILED DESCRIPTION OF THE INVENTION

The present invention now will be described more fully hereinafter with reference to certain preferred embodiments. These embodiments are provided so that this disclosure will be thorough and complete, and will fully convey the scope of the invention to those skilled in the art. Indeed, the invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise. Use of the term "transverse" does not strictly require a 90° angle between the transverse elements, but encompasses elements positioned at an angle that deviates from 90° by a relatively small margin (e.g., a deviation of no more than about 20 degrees).

The container embodiments described in the present application can be used to store and dispense any solid products, but are particularly well-suited for products designed for oral consumption. Exemplary consumable products include pharmaceutical products such as pills and tablets, cigarettes and other smoking products, smokeless tobacco products, candies, mints, gums and other confectionary products, snacks, and the like.

Exemplary tobacco products include pelletized tobacco products (e.g., compressed or molded pellets produced from powdered or processed tobacco, such as those formed into the general shape of a coin, cylinder, bean, pellet, sphere, obloid, cube, bead, or the like), extruded or cast pieces of tobacco (e.g., as strips, films or sheets, including multilayered films formed into a desired shape), products incorporating tobacco carried by a solid substrate (e.g., where substrate materials range from edible grains to inedible cellulosic sticks), extruded or formed tobacco-containing rods or sticks, tobacco-containing capsule-like materials having an outer shell region and an inner core region, straw-like (e.g., hollow formed) tobacco-containing shapes, sachets or packets containing tobacco (e.g., snus-like products), pieces of tobacco-containing gum, and the like.

Exemplary smokeless tobacco compositions that can be packaged in the containers of the invention are set forth in, for example, U.S. Pat. Nos. 1,376,586 to Schwartz; 3,368,567 to Speer; 3,696,917 to Levi; 4,513,756 to Pittman et al.; 4,528,993 to Sensabaugh, Jr. et al.; 4,606,357 to Dusek et al; 4,624,269 to Story et al.; 4,802,498 to Ogren; 4,821,749 to Toft et al.; 4,975,270 to Kehoe; 4,987,907 to Townsend; 4,991,599 to Tibbetts; 5,092,352 to Sprinkle, III et al.; 5,167,244 to Kjerstad; 5,387,416 to White; 6,668,839 to Williams; 6,834,654 to Williams; 6,953,040 to Atchley et al.; and 7,032,601 to Atchley et al.; US 2002/0162562 to Williams; US 2003/0070687 to Atchley et al.; US 2004/0020503 to Williams; US 2005/0178398 to Breslin et al.; US 2005/0244521 to Strickland et al.; US 2006/0191548 to Strickland et al.; US 2007/0062549 to Holton, Jr. et al.; US 2007/0186941 to Holton, Jr. et al.; US 2007/0186942 to Strickland et al.; US 2008/0029110 to Dube et al.; and US 2008/0029116 to Robinson et al; US 2008/0029117 to Mua et al.; US 2008/0173317 to Robinson et al.; US 2008/0196730 to Engstrom et al.; US 2008/0209586 to Neilsen et al.; and US 2009/0065013 to Essen et al., each of which is incorporated herein by reference. Various manners or methods for packaging smokeless tobacco products are set forth in US 2004/0217024 and US 2006/0118589 to Arnarp et al.; WO 2005/016036 to Bjorkholm; WO 2006/034450 to Budd; WO 2007/017761 to Kutsch et al.; and WO 2007/067953 to Sheveley et al. All of the above-cited references are incorporated by reference herein in their entirety.

Smokeless tobacco compositions utilized as the product contained in the containers of the invention will often include such ingredients as tobacco (typically in particulate form), sweeteners, binders, colorants, pH adjusters, fillers, flavoring agents, disintegration aids, antioxidants, oral care additives, and preservatives. See, for example, US 2007/0186941 to Holton et al.

The size and shape of the product to be stored and dispensed can vary. Exemplary product shapes include pills, tablets, spheres, strips, films, sheets, coins, cubes, beads, ovoids, obloids, cylinders, bean-shaped, sticks, or rods. Cross-sectional shape of the products can vary, and exemplary cross-sectional shapes include circles, squares, ovals, rectangles, and the like. The dimensions of the product will often vary depending on its shape. In one embodiment, the product is pellet or bean-shaped, and has a length and width in the range of about 3 mm to about 20 mm, more typically about 5 to about 12 mm.

The shape of the outer surface of the containers of the invention can vary. Although the container embodiments illustrated in the drawings have certain contours, containers with other exterior surface designs could also be used. For example, the sides or edges of the containers of the invention could be flattened, rounded, or beveled, and the various surfaces or edges of the container exterior could be concave or convex. Further, the opposing sides, ends, or edges of the container can be parallel or non-parallel such that the container becomes narrower in one or more dimensions.

The dimensions of the containers described herein can vary without departing from the invention. However, in preferred embodiments, the containers of the invention can be described as having a size suitable for handheld manipulation and operation. Exemplary dimensions for such handheld embodiments include lengths in the range of about 25 mm to about 200 mm, more typically about 50 mm to about 150 mm, and most often about 80 mm to about 120 mm. Exemplary widths include the range of about 10 mm to about 100 mm, more typically about 20 mm to about 80 mm, and most often about 30 mm to about 60 mm. As used herein, length and width refer to the major dimensions of the container that define the major plane of the container. Exemplary depths for handheld container embodiments of the invention range from about 5 mm to about 50 mm, more typically about 8 mm to about 30 mm, and most often about 10 mm to about 20 mm.

The number of solid product units stored in the containers of the invention can also vary, depending on the size of the container and the size of the product units. Typically, the number of stored product units will vary from about 5 to about 100, more typically about 10 to about 50, and most often about 15 to about 30.

The material of construction of the container can also vary. Exemplary materials include metal, wood, and synthetic plastic materials. Polymeric materials that can be extruded and/or molded into desired shapes are typically utilized, such as polyethylene, polystyrene, polyamide, and the like.

In certain embodiments, the containers of the invention combine several advantageous features, such as child-resistance and metered dispensing of a product. In particular, certain embodiments of the containers of the invention include a child-resistant locking mechanism that releasably locks an inner tray of the container in a closed and locked position. The locking mechanism can be released and a product dispensed using a series of manipulations including, for example, depressing a locking button and sliding an inner tray to expose the product to be dispensed. The containers of the invention provide, in certain embodiments, metered dispensing of the product by providing a dispensing aperture sized for passage of a single unit of the product so that only a single unit of product can enter the dispensing aperture at one time.

FIGS. 1-11 illustrate a container embodiment 10 that is particularly well-suited for storage and dispensing of a product having a pellet or bean shape. FIGS. 1-3 provide views of a container embodiment 10 in a closed and locked position. The container 10 includes an outer casing 12, and the outer casing includes an open end 20 that provides access to an interior compartment. An inner tray 28 is received within the interior compartment of the outer casing 12.

As shown in FIGS. 4 and 5, certain embodiments of the outer casing 12 can include a top 14 and a bottom 16. FIG. 4 presents a perspective view of a top 14 of the outer casing 12. FIG. 5 presents a perspective view of a bottom 16 of the outer casing 12.

Referring to FIGS. 3 and 5, the bottom 16 of the outer casing 12 includes a depressible button 40 and has a cutout section shaped to receive the lower edge of the inner tray 28 while maintaining a depression 34 between the bottom of the outer casing and the inner tray. The depression provides a convenient place for grasping of the inner tray 28 by the user. For example, the depression is advantageously sized and configured to accommodate a fingernail or fingertip of the user for purposes of grasping the inner tray.

FIGS. 6 and 7 set forth perspective views of the inner tray 28. FIG. 6 provides a view of the top surface of the inner tray 28 and FIG. 7 faces the bottom surface of the inner tray. In one embodiment, the inner tray comprises separate top and bottom portions. FIGS. 8 and 9 provide side views of one example of a bottom portion of the inner tray 28 and FIGS. 10 and 11 provide side views of one example of a top portion of the inner tray 28.

As shown in FIGS. 6 and 10, the inner tray 28 includes a dispensing aperture 30 through which the user of the container 10 can remove a unit of product stored within the container. The inner tray 28 can include a depression 66 around the dispensing aperture 30. The top of the inner tray 28 also includes a stop 60 having a raised profile above the main surface of the top of the inner tray. The stop 60 of the inner tray 28 is sized and configured to engage a projecting lip 64 near the open end 20 of the outer casing 12 (see FIG. 4). Interaction between the stop 60 and the projecting lip 64 of the top 14 of the outer casing 12 prevents complete removal of the inner tray 28 from the outer casing as the inner tray slides towards the dispensing position.

As shown in FIG. 7, the bottom surface of the inner tray 28 (i.e., the surface adapted for facing the bottom 16 of the outer casing 12) includes a lip 52 shaped in a manner that corresponds to a cutout in the bottom 16 of the outer casing 12. The lip 52 is sized and configured for abutting contact with the corresponding shaped cutout in the bottom 16 of the outer casing 12 (see FIG. 5). Although the illustrated embodiment of the lip 52 has an arcuate edge that abuts the outer casing 12, any shape can be utilized without departing from the invention. Abutting contact between the lip 52 and the outer casing 12 leaves a depression 34 by virtue of the shape of the cutout in the outer casing, the depression providing a convenient location for the user to place a finger for grasping the inner tray 28 in order to slide the tray from the outer casing. As shown in FIG. 3, the cutout in the bottom 16 of the outer casing 12 at the open end 20 thereof is shaped such that a portion of the leading edge of the cutout is spaced away from the lip 52 of the inner tray 28.

As also shown in FIG. 7, the inner tray 28 includes a flexible locking tab 42 positioned at the end of the inner tray that is retained within the outer casing 12. The locking tab 42 is adjacent to an opening 50 in the bottom surface of the inner tray 28, and comprises a first segment 52 extending toward the opposing end of the inner tray where the lip 52 is located and a second segment 54 transverse to the first segment having a surface facing the opening. The illustrated version of the locking tab 42 also includes multiple ribs 62 extending between the two segments, each rib having a beveled surface.

As shown in FIG. 9, the locking tab 42 can include one or more strengthening ribs 44 on the interior surface thereof that aid in prevention of permanent deformation of the flexible locking tab after repeated use. FIG. 9 also illustrates the side walls 82 that define a storage compartment 26 contained within the inner tray 28. As shown, the storage compartment 26 can have a wider section proximal to the locking tab 42 and a narrower section distal from the locking tab. The narrower section is positioned proximal to the dispensing aperture shown in FIGS. 6, 10, and 11.

Returning to FIG. 5, the depressible button 40 is defined by a semi-circular cut that weakens a portion of the bottom 16 and increases the flexibility of the button. The underside of the button 40 can include one or more strengthening ribs 70 adapted to strengthen the button 40 and prevent permanent deformation of the button after repeated use. The illustrated embodiment of the outer casing 12 also includes two projections 46 adjacent to the depressible button 40. The projections 46 preferably include a beveled surface facing the open end 20 of the outer casing 12. The beveled surface facilitates sliding of the locking tab 42 over the projections 46 as the inner tray 28 slides into the closed and locked position. In certain embodiments, the beveled surface of the projections 46 are positioned to engage the beveled surfaces of the ribs 62 extending from the locking tab 42, which can provide a smooth sliding action as the inner tray 28 moves into the closed and locked position.

In addition, the projections 46 typically include a surface transverse to the top and bottom of the outer casing 12, the transverse surface facing the depressible button 40 and positioned to engage the corresponding transverse surface of the second segment 54 of the locking tab 42 when the container is in the closed and locked position.

The projections 46 are also sized for engagement within the opening 50 of the inner tray 28 when the inner tray is in the closed and locked position. The size and shape of the projections 46 and the corresponding opening 50 can vary without departing from the invention.

While in the closed and locked position, the locking tab 42 is positioned overlying the flexible button 40. As a result, depressing button 40 toward the interior of the container 10 will result in engagement with the locking tab 42. Sufficient flexing of the locking tab 42 toward the interior of the inner tray 28 will cause disengagement of the projections 46 from the locking tab. Once the locking tab 42 is clear of the projections 46, the user can freely slide the inner tray 28 toward the dispensing position. As shown in FIG. 7, the locking tab 42 can include additional ribs 62 positioned centrally within the locking tab that engage the button 40 as the button is depressed and reduce the linear displacement of the button required to unlock the container 10.

Although the illustrated embodiment of the outer casing 12 and the inner tray 28 each comprise two separate interlocking pieces, the outer casing and/or inner tray could have a unitary structure or comprises more than two interlocking pieces if desired. Any means for connecting multiple pieces of a container could be used without departing from the invention. For example, in the illustrated embodiment, the top 14 and bottom 16 of the outer casing 12 can be connected through interaction between slots 74 on the top and corresponding tabs 78 on the bottom shown in FIGS. 4 and 5.

As part of the final packaging process, once the dispensing containers of the invention are filled with the desired product, the containers can be over-wrapped or over-sealed with a film material, or shrink-wrapped with such a material. The outer packaging material useful in accordance with the present invention can vary. Typically, the selection of the packaging material is dependent upon factors such as aesthetics, transparency, comfort of handling, desired barrier properties (e.g., so as to provide protection from exposure to oxygen or radiation, or so as to provide protection from loss of moisture), or the like. The packaging material preferably has the form of a film, such as a laminated film (e.g., a co-extruded laminated film). Representative materials that can be used to provide components or layers of film materials or laminated films include polyvinyl chloride, ethylene vinyl acetate co-polymer, oriented polypropylene, linear low density polyethylene, polyvinylidene dichloride, polyester terephthalate, ethylene methacrylic acid co-polymer, metallacene linear low density polyethylene, cellulosic materials (e.g., cellophane), and the like. Exemplary packaging materials can be plastic/metal films, plastic/metal films that are paper coated, plastic laminate films, or the like. US 2008/0029116 to Robinson et al. discloses examples of suitable packaging materials.

Many modifications and other embodiments of the inventions set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dispensing container, comprising:

an outer casing having an open end, a top, a bottom, sidewalls extending between the top and bottom, and an interior compartment, wherein the outer casing further includes a depressible button in the top or bottom and at least one projection adjacent to the depressible button that extends into the interior compartment, wherein the at least one projection of the outer casing has a beveled surface facing toward the open end of the outer casing; and an inner tray slidably received within the interior compartment of the outer casing and comprising a storage compartment configured to store a plurality of units of product to be dispensed and a dispensing aperture through which units of product can be dispensed from the storage compartment, the inner tray extending outwardly from the open end of the outer casing and configured for sliding movement between a closed and locked position and a dispensing position, wherein the inner tray further comprises a first end received within the outer casing, an opposing second end extending outwardly from the outer casing, a flexible locking tab positioned proximal to the first end, and an opening adjacent to the flexible locking tab, the flexible locking tab comprising a first segment extending toward the second end of the inner tray, a second segment extending transversely from the first segment, wherein the second segment provides a surface facing the opening and operatively positioned to engage the at least one projection of the outer casing when the inner tray is in the closed and locked position, and at least one rib extending between the first segment and the second segment of the flexible locking tab, the at least one rib having a beveled surface positioned to engage the beveled surface of the at least one projection of the outer casing to facilitate movement of the inner tray between the dispensing position and the closed and locked position, and wherein the depressible button of the outer casing is operatively positioned to engage and deflect the flexible locking tab of the inner tray when the inner tray is in the closed and locked position.

2. The dispensing container of claim 1, wherein the at least one projection further comprises a surface transverse to the top or bottom of the outer casing and positioned to engage the second segment of the flexible locking tab of the inner tray when the inner tray is in the closed and locked position.

3. The dispensing container of claim 1, wherein the second end of the inner tray comprises a lip extending transverse to the longitudinal axis of the inner tray, the lip positioned to abut the top or bottom of the outer casing.

4. The dispensing container of claim 3, further comprising a depression formed between the lip of the inner tray and the top or bottom of the outer casing for facilitating grasping of the inner tray.

5. The dispensing container of claim 1, wherein the storage compartment comprises a first section distal from the dispensing aperture and a narrower second section proximal to the dispensing aperture.

6. The dispensing container of claim 1, wherein the inner tray further comprises a stop adapted for engaging the outer casing to prevent removal of the inner tray from the outer casing.

7. The container of claim 1, wherein the product is characterized by a shape selected from the group consisting of pill, tablet, sphere, sheet, coin, cube, bead, ovoid, obloid, bean, stick, and rod.

8. The container of claim 1, wherein the product is selected from the group consisting of pharmaceutical products, smoking products, smokeless tobacco products, snack products, and confectionary products.

9. The container of claim 1, wherein the product is a smokeless tobacco product.

10. The container of claim 1, wherein the product is selected from the group consisting of pharmaceutical products, candies, mints, and gums.

11. A dispensing container, comprising:

an outer casing having an open end, a top, a bottom, sidewalls extending between the top and bottom, and an interior compartment, wherein the outer casing further includes a depressible button in the top or bottom and at least one projection adjacent to the depressible button that extends into the interior compartment; and an inner tray slidably received within the interior compartment of the outer casing and comprising a storage compartment configured to store a plurality of units of product to be dispensed and a dispensing aperture through which units of product can be dispensed from the storage compartment, the inner tray extending outwardly from the open end of the outer casing and configured for sliding movement between a closed and locked position and a dispensing position, wherein the inner tray further comprises a first end received within the outer casing, an opposing second end extending outwardly from the outer casing, a flexible locking tab positioned proximal to the first end, and an opening adjacent to the flexible locking tab, the flexible locking tab comprising a first segment extending toward the second end of the inner tray and a second segment extending transversely from the first segment, wherein the second segment provides a surface facing the opening and operatively positioned to engage the at least one projection of the outer casing and the at least one projection extends through the opening when the inner tray is in the closed and locked position, and wherein the depressible button of the outer casing is operatively positioned to engage and deflect the flexible locking tab of the inner tray when the inner tray is in the closed and locked position.

12. The dispensing container of claim 11, further comprising at least one rib extending between the first segment and the second segment of the flexible locking tab, the at least one rib having a beveled surface positioned to engage a beveled surface of the at least one projection of the outer casing to facilitate movement of the inner tray between the dispensing position and the closed and locked position.

13. The dispensing container of claim 11, further comprising at least one rib extending between the first segment and the second segment of the flexible locking tab and having a surface positioned to engage the depressible button of the outer casing to facilitate deflection of the flexible locking button when the inner tray is in the closed and locked position.

14. The container of claim 11, wherein the product is characterized by a shape selected from the group consisting of pill, tablet, sphere, sheet, coin, cube, bead, ovoid, obloid, bean, stick, and rod.

15. The container of claim 11, wherein the product is selected from the group consisting of pharmaceutical products, smoking products, smokeless tobacco products, snack products, and confectionary products.

16. The container of claim 11, wherein the product is a smokeless tobacco product.

17. The container of claim 11, wherein the product is selected from the group consisting of pharmaceutical products, candies, mints, and gums.

18. The dispensing container of claim 11, wherein the at least one projection further comprises a surface transverse to the top or bottom of the outer casing and positioned to engage the second segment of the flexible locking tab of the inner tray when the inner tray is in the closed and locked position.

19. The dispensing container of claim 11, wherein the at least one projection of the outer casing has a beveled surface facing toward the open end of the outer casing.

20. The dispensing container of claim 19, wherein the at least one projection further comprises a surface transverse to the top or bottom of the outer casing and positioned to engage the second segment of the flexible locking tab of the inner tray when the inner tray is in the closed and locked position.

21. The dispensing container of claim 11, wherein the second end of the inner tray comprises a lip extending transverse to the longitudinal axis of the inner tray, the lip positioned to abut the top or bottom of the outer casing.

22. The dispensing container of claim 21, further comprising a depression formed between the lip of the inner tray and the top or bottom of the outer casing for facilitating grasping of the inner tray.

23. The dispensing container of claim 11, wherein the storage compartment comprises a first section distal from the dispensing aperture and a narrower second section proximal to the dispensing aperture.

24. The dispensing container of claim 11, wherein the inner tray further comprises a stop adapted for engaging the outer casing to prevent removal of the inner tray from the outer casing.

* * * * *

UNITED STATES PATENT AND TRADEMARK OFFICE

CERTIFICATE OF CORRECTION

PATENT NO. : 8,096,411 B2
APPLICATION NO. : 12/685819
DATED : January 17, 2012
INVENTOR(S) : Bailey et al.

It is certified that error appears in the above-identified patent and that said Letters Patent is hereby corrected as shown below:

ON THE TITLE PAGE:

Item (73) Assignee: "R. J. Reynolds Tabacco Company"

should read --R. J. Reynolds Tobacco Company--

Signed and Sealed this
Tenth Day of April, 2012

David J. Kappos

David J. Kappos
*Director of the United States Patent and Trademark Office*